US005412922A

United States Patent [19]

Vittori et al.

[11] Patent Number: 5,412,922

[45] Date of Patent: May 9, 1995

[54] REPLACEMENT WINDOW AND METHOD

[75] Inventors: Bernardo Vittori, Bridgeport; Robert A. Harbinson, Shelton, both of Conn.

[73] Assignee: A.M.S.-Derby Inc., Derby, Conn.

[21] Appl. No.: 153,021

[22] Filed: Nov. 15, 1993

[51] Int. Cl.[6] ..... E04G 23/02

[52] U.S. Cl. ..... 52/745.16; 49/380; 49/506; 52/204.591; 52/207; 52/208; 52/745.15

[58] Field of Search ..... 52/745.15, 745.16, 745.11, 52/207, 204.51, 208, 745.2, 400, 398, 397; 49/506, 507, 400, 401, 402, 380

[56] References Cited

U.S. PATENT DOCUMENTS

| | | | |
|---|---|---|---|
| 2,939,185 | 6/1960 | Ader et al. | 49/380 |
| 2,976,583 | 3/1961 | McCarthy | 52/745.15 X |
| 2,984,299 | 5/1961 | Vallarelli et al. | 49/380 X |
| 4,250,673 | 2/1981 | Hubbard | 52/211 |
| 4,335,550 | 6/1982 | Johnson | 52/99 |
| 4,882,877 | 11/1989 | Guetle, Jr. et al. | 49/506 |
| 5,038,537 | 8/1991 | Frambach | 52/207 |
| 5,157,881 | 10/1992 | Tashman et al. | 52/98 |

*Primary Examiner*—Philip C. Kannan
*Attorney, Agent, or Firm*—John H. Crozier

[57] ABSTRACT

In a preferred embodiment, a method of replacing an existing window of the type having an existing fixed metal frame mounted in an existing window opening, the method including: removing elements of the existing window, except the existing fixed metal frame, while leaving the existing fixed metal frame in place and without rebuilding the existing window opening; providing a replacement window having a glazed monolithic frame member; and attaching the monolithic frame member to the existing metal frame by inserting fasteners through the monolithic frame member directly into the existing fixed metal frame.

14 Claims, 7 Drawing Sheets

REPLACEMENT WINDOW AND METHOD

BACKGROUND OF THE INVENTION

1. Field of the Invention

The present invention relates to windows generally and, more particularly, but not by way of limitation, to a novel replacement window that is economically and rapidly installed and to a method of installing such a window.

2. Background Art

There is a major problem with replacing steel frame windows, particularly those in brick, block, and/or stone walls, in that the replacement usually involves having to do a certain amount of rebuilding of the window openings. This procedure is relatively expensive and also requires that the area in which the window is located be isolated for a fairly long period of time. The problem is especially serious in health care facilities where, typically, whole floors must be closed during window replacement because of the reconstruction activities. Also, most known replacement windows reduce the amount of glass area.

Accordingly, it is a principal object of the present invention to provide a replacement window for steel frame windows that can be quickly installed and a method of installing such a window.

It is a further object of the invention to provide such a window that is economically constructed.

It is an additional object of the invention to provide such window and method that do not require rebuilding of brick/block and/or stone walls in which the replacement windows are installed.

It is another object of the invention to provide such a replacement window which does not decrease the amount of glass area in the window.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a method of replacing an existing window of the type having an existing fixed metal frame mounted in an existing window opening, comprising: removing elements of said existing window, except said existing fixed metal frame, while leaving said existing fixed metal frame in place and without rebuilding said existing window opening; providing a replacement window having a glazed monolithic frame member; and attaching said monolithic frame member to said existing metal frame by inserting fasteners through said monolithic frame member directly into said existing fixed metal frame.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
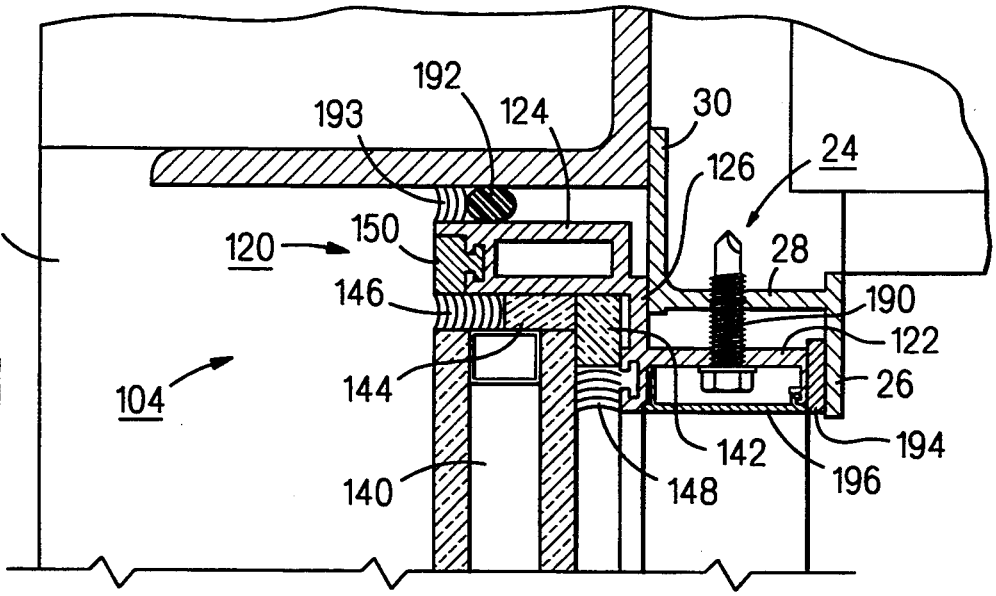
FIG. 1 is a fragmentary, cross-sectional, side elevational view taken along line "1—1" of FIG. 9.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 10:
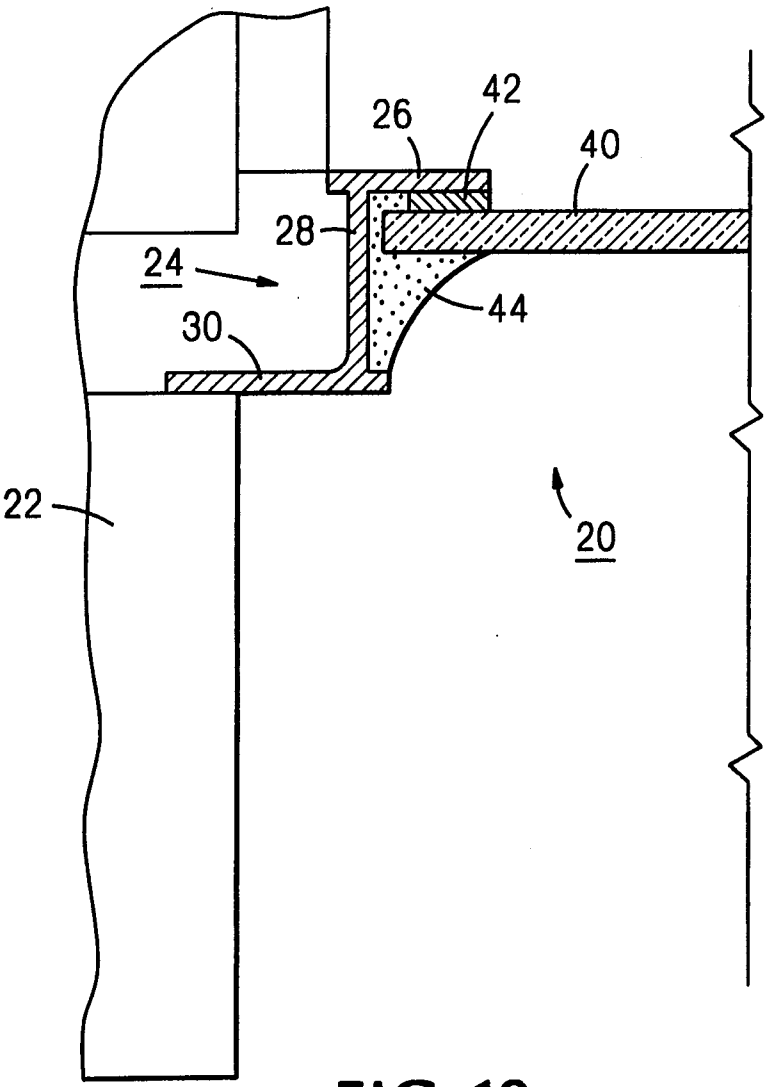
FIG. 10 is a fragmentary, cross-sectional, plan view of a conventionally constructed steel frame window having a fixed sash.

Reference first should be made to FIG. 10 which illustrates a conventional, fixed sash window, generally indicated by the reference numeral 20, set in a wall 22 which may be of brick, block, and/or stone construction. Window 20 includes a frame, generally indicated by the reference numeral 24, typically constructed of steel, fixedly mounted in wall 22 by conventional means (not shown). Frame 24 includes rear, intermediate, and front flange members 26, 28, and 30, respectively. A glass pane 40 is set in frame 24 against rear flange 26, with a compressible filler strip 42 disposed between the pane and the rear flange. A caulking material 44 disposed between intermediate flange 28 and the edge of the outer surface of pane 40 secures the pane in place in frame 24.

Figure 11:
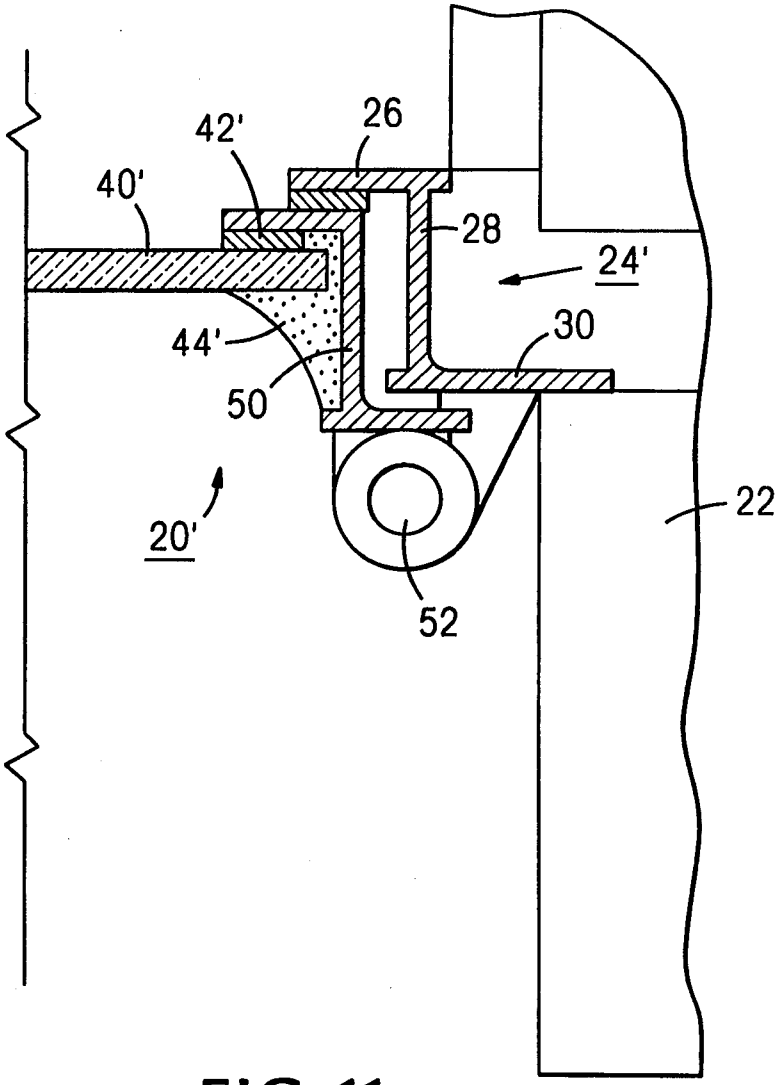
FIG. 11 is a fragmentary, cross-sectional, plan view of a conventionally constructed steel frame window having an operating sash.

FIG. 11 illustrates another conventionally constructed metal frame window, generally indicated by the reference numeral 20', of the operating sash type. Here, pane 40' is set in a movable frame 50 which is hingedly attached to front flange 30' of window frame 24' by means of an operator 52.

Figure 9:
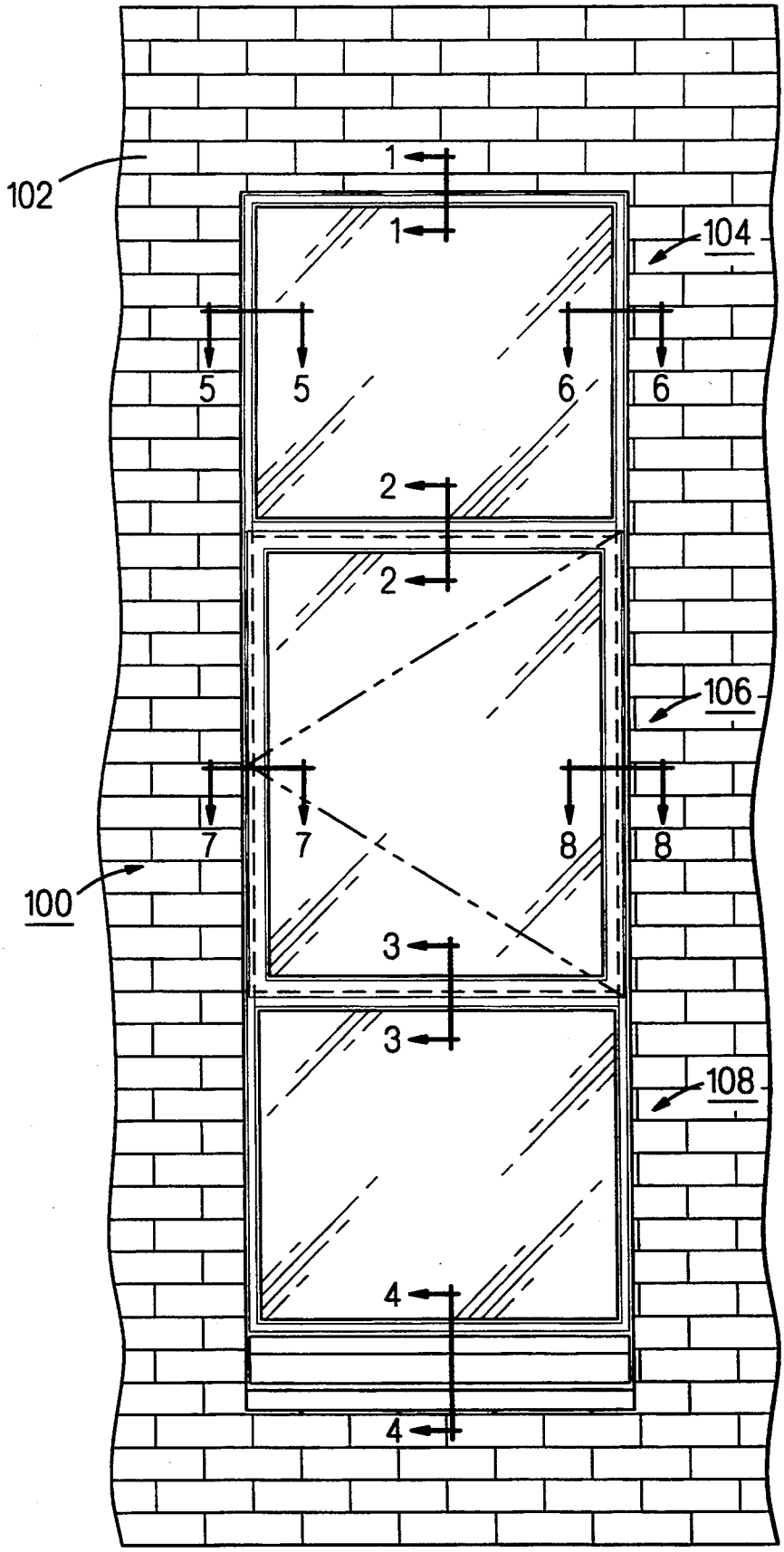
FIG. 9 is a front elevational view of a window constructed according to the present invention, installed in a masonry wall.

FIG. 9 illustrates a replacement window, generally indicated by the reference numeral 100, constructed according to the present invention and installed in a masonry wall 102. It may be assumed that window 100 has replaced, for example, window 20 or 20' of FIGS. 10 and 11, respectively, as will be described in detail below. Window 100 is shown as having three sections 104, 106, and 108, window sections 104 and 108 being fixed and window section 106 being of the opening type; although, window 100 may be provided, if desired, as a single fixed window section, a single opening window section, or some other arrangement of window sections.

Figure 6:
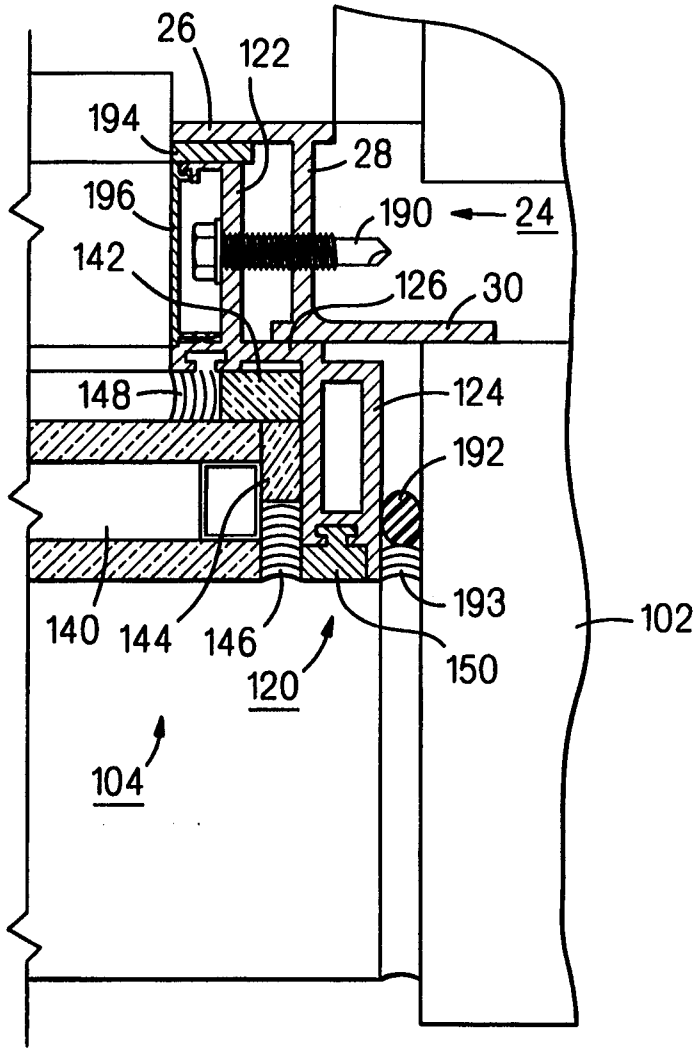
FIG. 6 is a fragmentary, cross-sectional, plan view taken along line "6—6" of FIG. 9.
Figure 5:
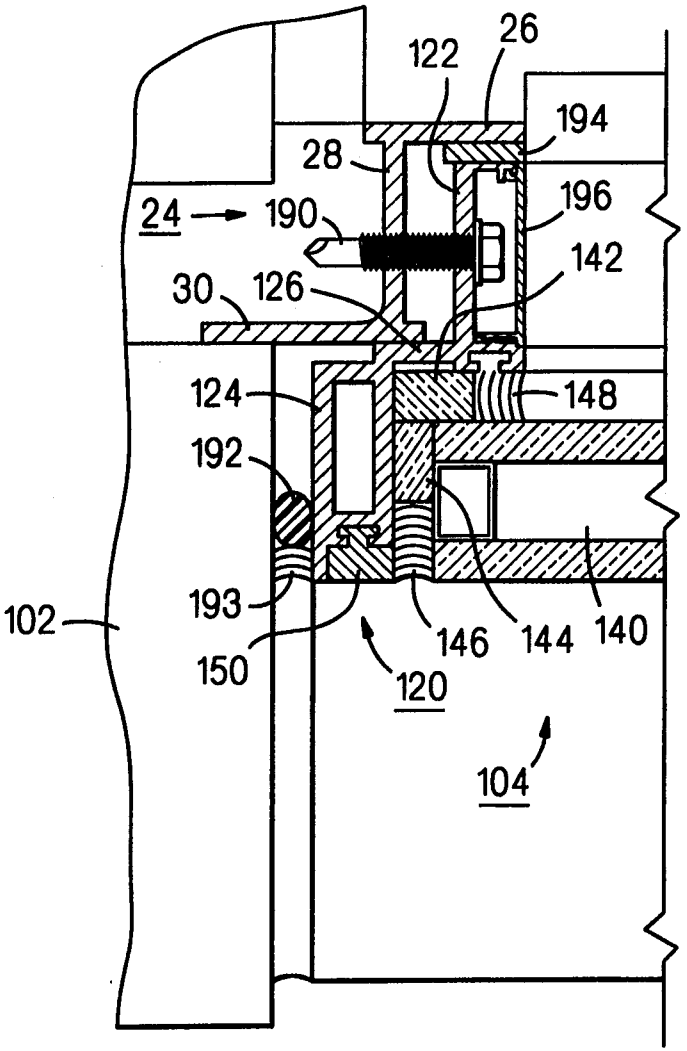
FIG. 5 is a fragmentary, cross-sectional, plan view taken along line "5—5" of FIG. 9.

Reference should now be made to FIGS. 1, 5, and 6 for an understanding of the construction of window section 104. It will be understood that sections taken through window section 108, similar to FIGS. 5 and 6, will be identical thereto.

Window section 104 includes a frame, generally indicated by the reference numeral 120, extending around the top and sides of the window section. Frame 120 is preferably an aluminum extrusion. Frame 120 includes a rearwardly extending rear flange member 122, a forwardly extending front flange member 124, and a crosswisely extending intermediate flange member 126 extending between and joining the rear and front flange members.

A double glass pane unit 140 is mounted in frame 120, with a strip of double-faced adhesive tape 142 disposed between the edge of the inner surface of the pane unit and intermediate flange member 126 and a strip of resilient material 144 disposed between the edge of the pane unit and front flange member 124. Pane unit 140 is secured in place by means of structural silicone material 146 and 148 placed against strip 144 and tape 142, respectively. A trim strip 150 covers the distal end of front flange member 124 to cover a groove not used in fixed sash.

Figure 8:
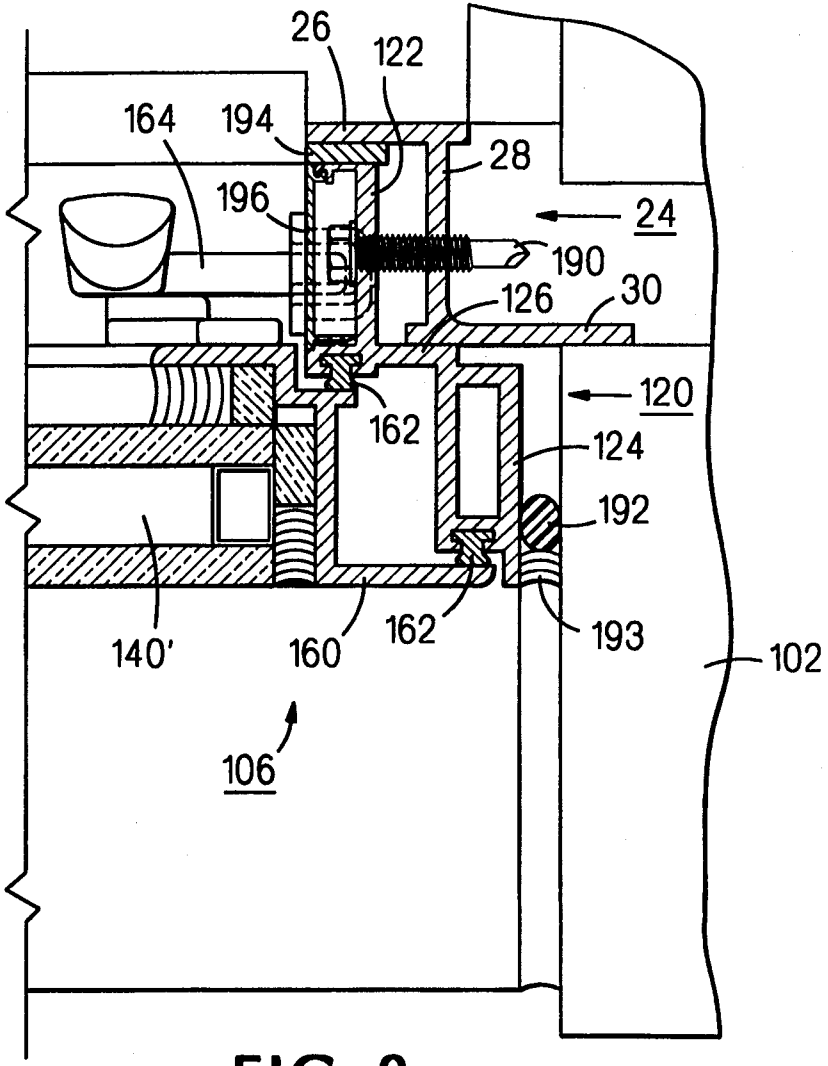
FIG. 8 is a fragmentary, cross-sectional, plan view taken along line "8—8" of FIG. 9.
Figure 7:
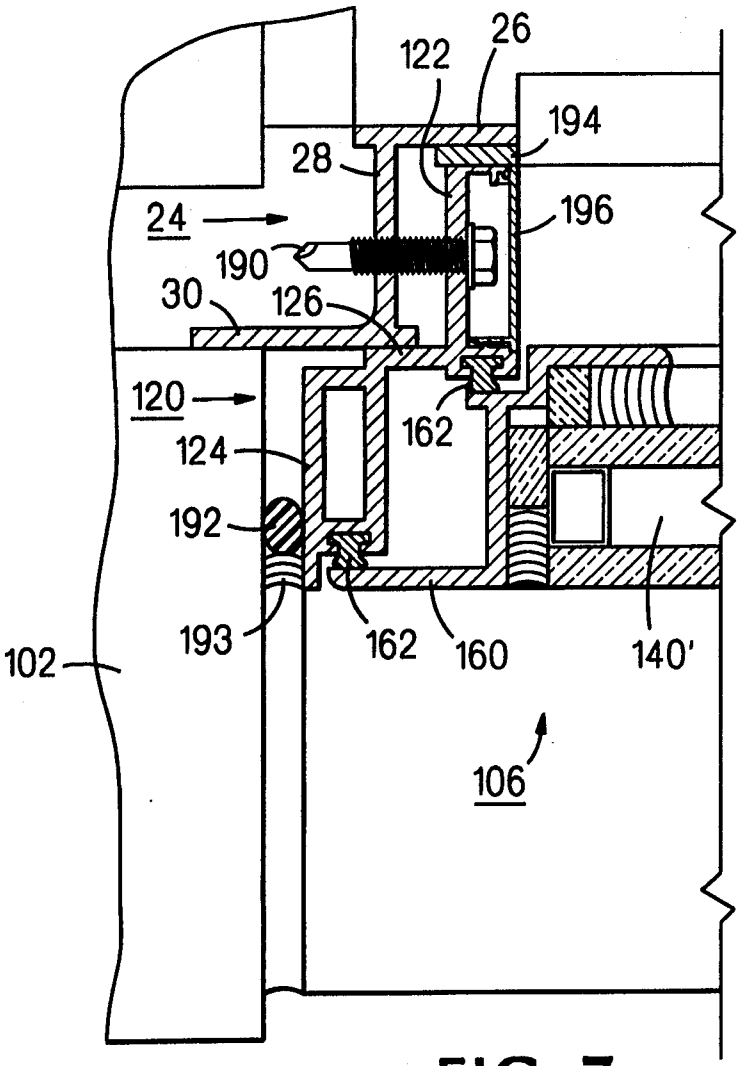
FIG. 7 is a fragmentary, cross-sectional, plan view taken along line "7—7" of FIG. 9.

Reference now should be made to FIGS. 7 and 8 for an understanding of the construction of window section 106. Here, a double glass pane unit 140', rather than being mounted in frame 120, is seated in a movable frame 160 in a manner similar to that described above with reference to the seating of double glass pane unit 140 in frame 24. Movable frame 160 is removably sealed to frame 24 by two weatherstrips 162 when the movable frame is in its closed position shown on FIGS. 7 and 8. An operator 164 is provided to cause movable frame 160 to move outwardly from frame 24 in a conventional manner.

Figure 2:
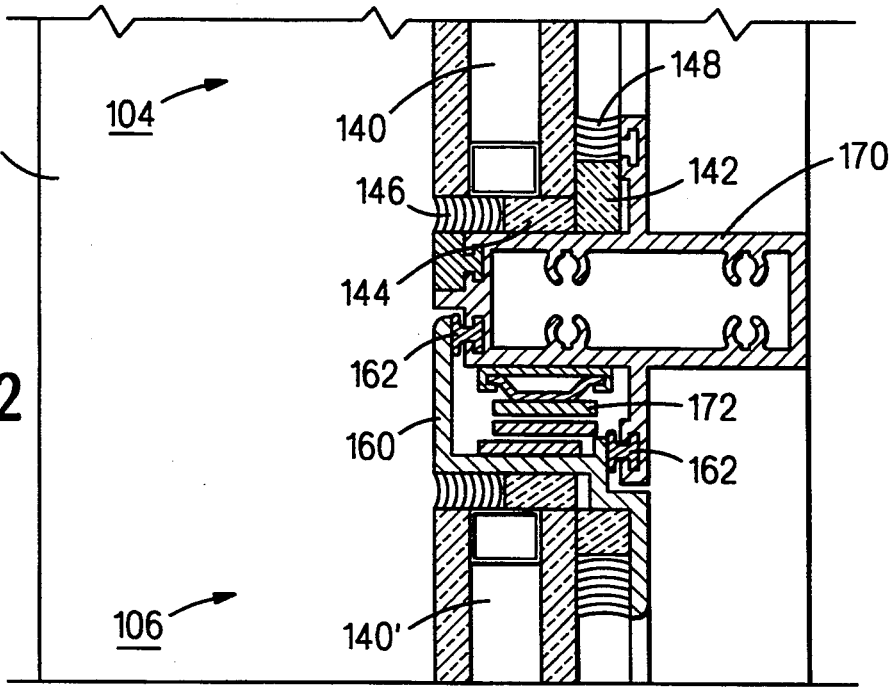
FIG. 2 is a fragmentary, cross-sectional, side elevational view taken along line "2—2" of FIG. 9.
Figure 3:
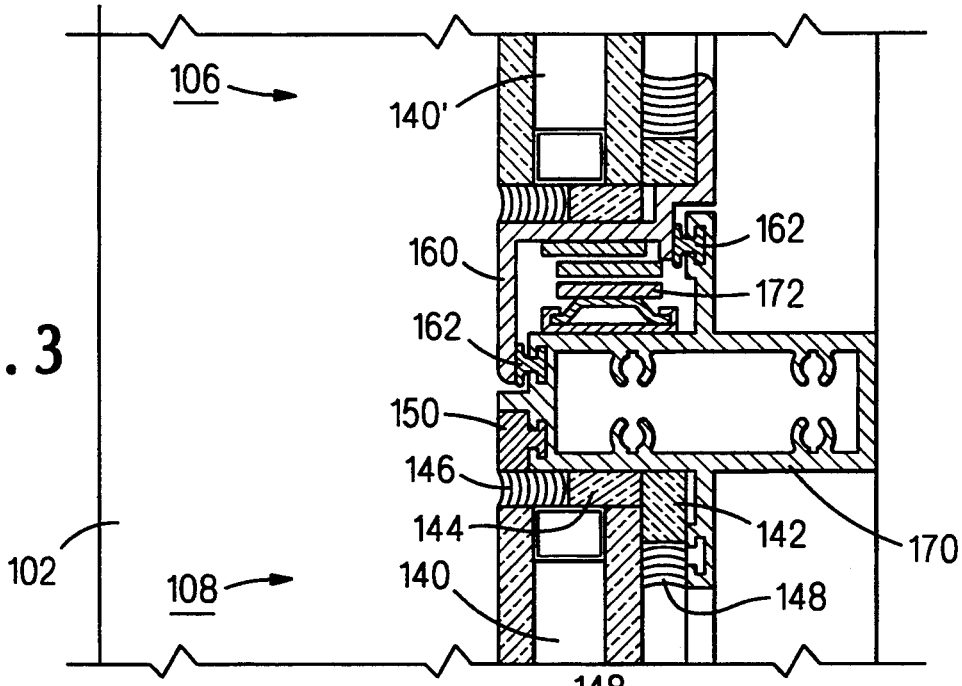
FIG. 3 is a fragmentary, cross-sectional, side elevational view taken along line "3—3" of FIG. 9.

Referring now to FIGS. 2 and 3, it will be seen that horizontal tubular frame members 170 are provided at the junction of window sections 104 and 106 and at the junction of window sections 106 and 108, the tubular frame members preferably being aluminum extrusions. Conventional four-arm hinges 172 are disposed between tubular frame members 170 and movable frame 160 to permit the movable frame to move outwardly from frame 120 (FIGS. 7 and 8) and thus open window section 106.

Figure 4:
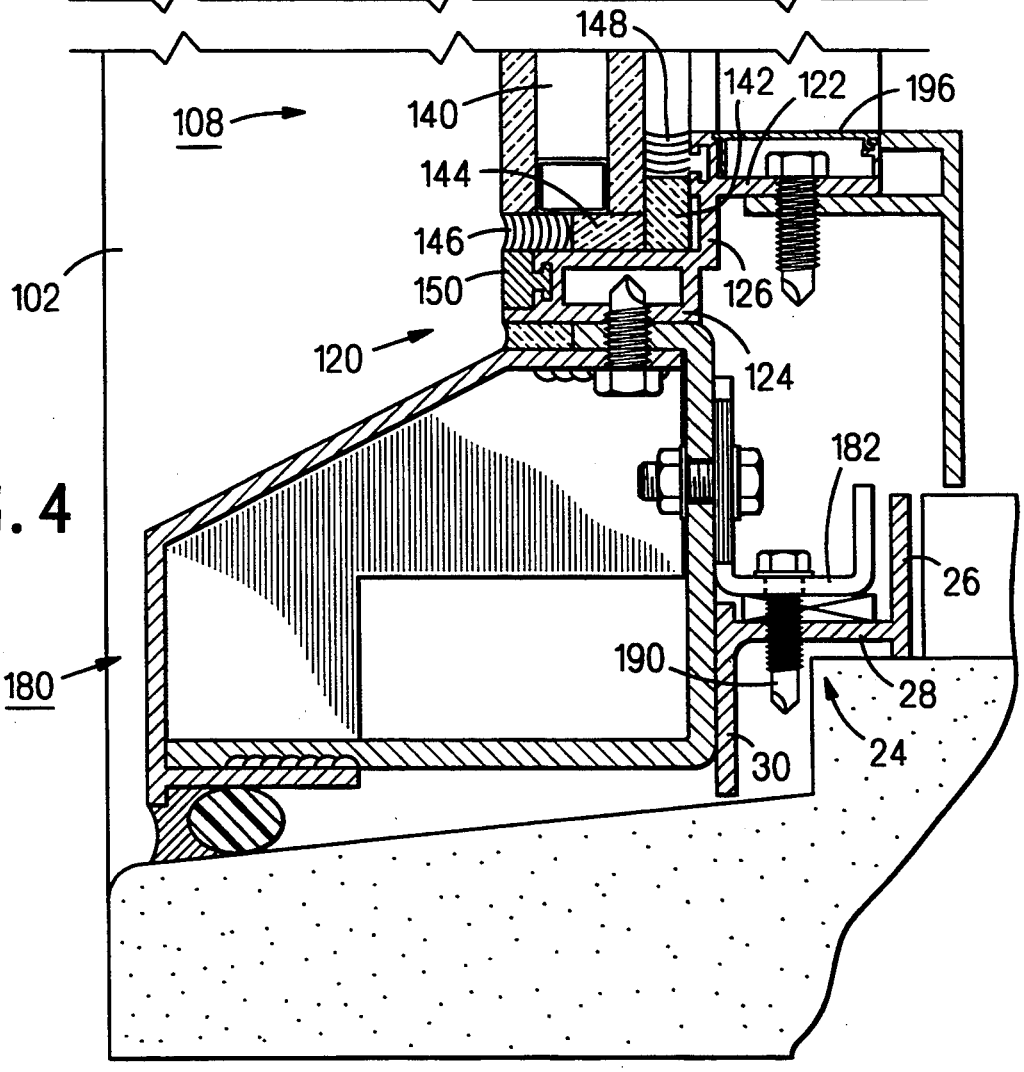
FIG. 4 is a fragmentary, cross-sectional, side elevational view taken along line "4—4" of FIG. 9.

Referring to FIG. 4, it will be seen that frame 120 at the lower edge of window section 108 is attached to a sill unit, generally indicated by the reference numeral 180. Since the configuration of sill unit 180 may be varied greatly from installation to installation, no description of the components thereof will be given, except to note that sill unit 180 includes a horizontal flange member 182 extending horizontally from the rear thereof.

All the elements of replacement window 100 described above may be conveniently and economically assembled as shown in a shop remote from the location of installation of the window. This greatly minimizes the time that must be spent at the job site.

To install window 100 in wall 102 (FIG. 9), if the existing window is fixed sash 20 (FIG. 10), first the existing glass pane 40 (FIG. 10) is removed from frame 24, leaving the frame in place. If the existing installation is operating sash 20' (FIG. 11), movable frame 50 and operator 52 are removed from frame 24, again leaving the frame in place. Should there be any horizontal or vertical intermediate frame members (not shown), those would be cut out of frame 24. Also, any remnants of sealing or bedding materials would be cleaned from frame 24.

Next, window 100 as described above is placed against frame 24 (FIG. 5, for example) with intermediate flange member 126 of frame 120 abutting front flange member 30 of frame 24. Now, a plurality of self-drilling, self-tapping steel screws 190 are used to fasten rear flange member 122 of frame 120 to intermediate flange member 28 of frame 24 and to fasten horizontal flange member 182 (FIG. 4) to the intermediate flange member.

To finish the installation, a back rod 192 (FIG. 5, for example) is placed between wall 102 and front flange member 124, slightly inwardly from the distal end of the latter and a caulking material 193 placed in the cavity thus defined thereby. A similar sealing arrangement is provided at the front edge of sill unit 180. A compressible filler material 194 (FIG. 5, for example) is placed between the distal end of rear flange member 122 and rear flange member 26. Trim panels 196 (FIG. 5, for example) are snapped in place, as shown, to cover screws 190.

Figure 12:
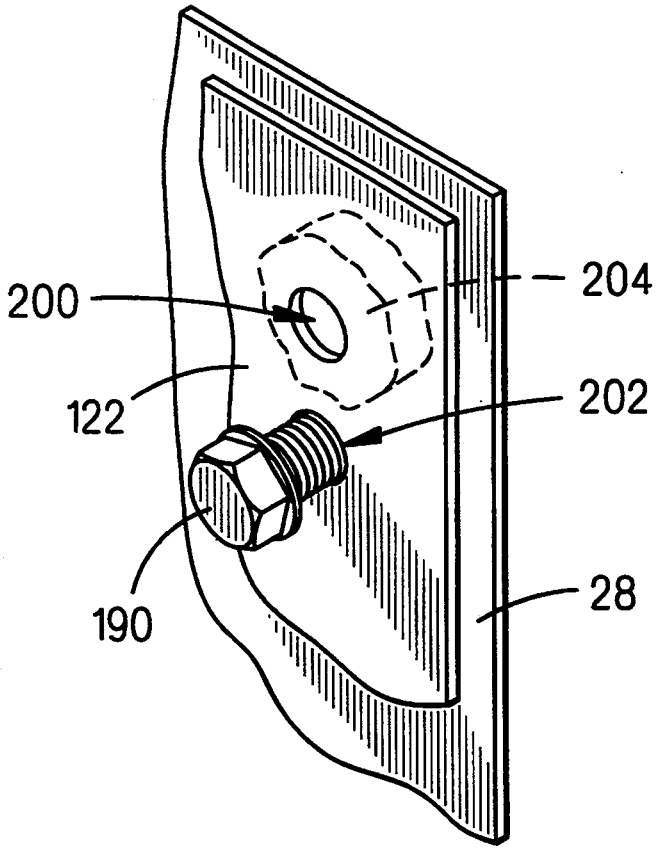
FIG. 12 is a fragmentary, perspective view illustrating a method of forming spacers in situ, useful in the present invention.

In mounting frame 120 to frame 24, it has been found desirable to be able to form, in situ, resilient spacers between rear flange member 122 of frame 120 and intermediate flange member 28 of frame 24. The method of doing so will be described with reference to FIG. 12. Here, two, generally vertically aligned, closely spaced, upper and lower holes 200 and 202, respectively, are drilled in rear flange member 122 and a screw 190 is inserted into lower hole 202 and started into intermediate flange member 28. Then, a resilient epoxy material 204 is injected into upper hole 200 and fills a portion of the space between flange members 28 and 122. Screw 190 is then tightened a desired amount to align window 100 (FIG. 9). When epoxy material 204 subsequently cures, it forms a resilient spacer of precisely the proper thickness between flange members 28 and 122.

It will be noted that the open glass area of window sections 104 and 108 (FIGS. 5 and 6) is as great as that of window 20 (FIG. 10) and that the open glass area of window section 106 (FIGS. 7 and 8) is nearly as great as that of window 20' (FIG. 11).

It will be understood that frame 120 may be modified as required to fit different configurations of frame 24; however, the basic method of the present invention will remain the same. That is, the removal of the glass pane(s) from an existing metal frame, while leaving the frame in place, and the direct attachment to the frame of a replacement window unit.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A method of replacing an existing window of the type having an existing fixed metal frame mounted in an existing window opening, comprising:

(a) removing elements of said existing window, except said existing fixed metal frame, while leaving said existing fixed metal frame in place and without rebuilding said existing window opening, including the step of removing an existing glass pane sealed directly to said existing fixed metal frame;

(b) providing a replacement window having a monolithic frame member; and (c) attaching said monolithic frame member to said existing metal frame by inserting fasteners through said monolithic frame member directly into said existing fixed metal frame.

2. A method, as defined in claim 1, wherein said monolithic frame member includes a flange member, monolithic therewith and extending therefrom, and said step of attaching includes: inserting fasteners through said flange member directly into said existing frame member.

3. A method, as defined in claim 1, wherein said step of attaching includes:

(a) forming two, generally vertically aligned, closely spaced, upper and lower holes through said monolithic frame member;

(b) injecting a curable material into said upper hole to partially fill a space defined between said monolithic frame member and said existing fixed metal frame;

(c) inserting one of said fasteners through said lower hole and tightening said one of said fasteners a desired degree; and (d) permitting said curable material to cure, so as to form a resilient spacer in said space defined between said monolithic frame member and said existing fixed metal frame.

4. A method, as defined in claim 3, further comprising providing as said curable material an epoxy material.

5. A replacement window for an existing window of the type having an existing fixed metal frame mounted in an existing window opening, comprising:

(a) a monolithic frame member insertable in said window opening against said existing fixed metal frame after elements of said existing window have been removed, except said existing fixed metal frame, while said existing fixed metal frame has been left in place and without rebuilding said existing window opening; and (b) fastening means for insertion through said monolithic frame member directly into said existing fixed metal frame to secure said monolithic frame member in said window opening;

wherein: said existing fixed metal frame includes a cross-wisely extending rear flange member, a cross-wisely extending front flange member, and a forwardly and rearwardly extending intermediate flange member extending between and joining opposite ends of said rear and front flange members, and said monolithic frame comprises:

(c) a rearwardly extending rear flange member, a forwardly extending front flange member, and a cross-wisely extending intermediate flange member extending between and joining said rear and front flange members; and (d) said flange members of said monolithic frame being arranged such that, when said replacement window is inserted in said existing window opening, said intermediate flange member of said monolithic frame will abut said front flange member of said existing fixed metal frame and said rear flange member of said monolithic frame will be parallely disposed with said intermediate flange member of said existing fixed metal frame for the fastening therebetween of said fastening means.

6. A replacement window, as defined in claim 5, wherein said replacement window is adapted for installation in an existing window of the type having an existing glass pane sealed directly to said existing fixed metal frame.

7. A replacement window, as defined in claim 5, wherein said replacement window is adapted for installation in an existing window of the type having a glazed, movable frame hinged to said existing fixed metal frame.

8. A replacement window, as defined in claim 5, wherein said monolithic frame member includes a flange member, monolithic therewith and extending therefrom, and said fastening means are for insertion through said flange member directly into said existing fixed metal frame.

9. A method of replacing an existing window of the type having an existing fixed metal frame mounted in an existing window opening, comprising:

(a) removing elements of said existing window, except said existing fixed metal frame, while leaving said existing fixed metal frame in place and without rebuilding said existing window opening, including the step of removing an operating sash having hinges attached directly to said existing fixed metal frame;

(b) providing a replacement window having a monolithic frame member; and (c) attaching said monolithic frame member to said existing metal frame by inserting fasteners through said monolithic frame member directly into said existing fixed metal frame.

10. A method, as defined in claim 9, wherein said monolithic frame member includes a flange member, monolithic therewith and extending therefrom, and said step of attaching includes: inserting fasteners through said flange member directly into said existing frame member.

11. A method, as defined in claim 9, wherein said step of attaching includes:

(a) forming two, generally vertically aligned, closely spaced, upper and lower holes through said monolithic frame member;

(b) injecting a curable material into said upper hole to partially fill a space defined between said monolithic frame member and said existing fixed metal frame;

(c) inserting one of said fasteners through said lower hole and tightening said one of said fasteners a desired degree; and (d) permitting said curable material to cure, so as to form a resilient spacer in said space defined between said monolithic frame member and said existing fixed metal frame.

12. A method, as defined in claim 11, further comprising providing as said curable material an epoxy material.

13. A method of replacing an existing window of the type having an existing fixed metal frame mounted in an existing window opening, comprising:

(a) removing elements of said existing window, except said existing fixed metal frame, while leaving said existing fixed metal frame in place and without rebuilding said existing window opening;

(b) providing a replacement window having a monolithic frame member;

(c) attaching said monolithic frame member to said existing metal frame by inserting fasteners through said monolithic frame member directly into said existing fixed metal frame (d) forming two, generally vertically aligned, closely spaced, upper and lower holes through said monolithic frame member;

(e) injecting a curable material into said upper hole to partially fill a space defined between said monolithic frame member and said existing fixed metal frame;

(f) inserting one of said fasteners through said lower hole and tightening said one of said fasteners a desired degree; and (g) permitting said curable material to cure, so as to form a resilient spacer in said space defined between said monolithic frame member and said existing fixed metal frame.

14. A method, as defined in claim 13, further comprising providing as said curable material an epoxy material.

* * * * *